US007832338B2

(12) United States Patent
Caro et al.

(10) Patent No.: US 7,832,338 B2
(45) Date of Patent: Nov. 16, 2010

(54) EXHAUST INTAKE BONNET FOR CAPTURING EXHAUSTS FROM DIESEL-POWERED LOCOMOTIVES

(76) Inventors: Sal Caro, 122 Tranquilla Dr., Camarillo, CA (US) 93012; Kevin Connolly, 5338 Gillespie St., Ventura, CA (US) 93003

( * ) Notice: Subject to any disclaimer, the term of this patent is extended or adjusted under 35 U.S.C. 154(b) by 776 days.

(21) Appl. No.: 11/370,373

(22) Filed: Mar. 8, 2006

(65) Prior Publication Data

US 2007/0209544 A1 Sep. 13, 2007

(51) Int. Cl.
*E04H 6/00* (2006.01)
*E21F 1/00* (2006.01)

(52) U.S. Cl. ..... 104/52; 454/166

(58) Field of Classification Search ..... 104/51, 104/52; 454/64, 166, 167
See application file for complete search history.

(56) References Cited

U.S. PATENT DOCUMENTS 1,887,025 A * 11/1932 Kelly ..... 104/52
4,086,847 A * 5/1978 Overmyer ..... 454/64
4,567,817 A * 2/1986 Fleischer et al. ..... 454/166
4,660,465 A * 4/1987 Jentzsch et al. ..... 454/64
4,744,305 A * 5/1988 Lim et al. ..... 104/52
5,655,962 A * 8/1997 Pfeiffer et al. ..... 454/64
6,983,757 B1 * 1/2006 Becker et al. ..... 137/14
7,086,941 B2 * 8/2006 Ennis ..... 454/64

* cited by examiner

*Primary Examiner*—S. Joseph Morano
*Assistant Examiner*—Robert J McCarry, Jr.
(74) *Attorney, Agent, or Firm*—Kenneth L. Green

(57) ABSTRACT

A bonnet captures exhaust gases from the exhaust pipes of diesel-powered locomotives. The bonnet includes a shell with a compliant fender. One or more of the bonnets are positioned over the exhaust pipe or pipes of the locomotive and are secured to the exhaust pipes or to a top surface of the locomotive. The bonnets are connected to a manifold, and the manifold carries the exhaust gasses to an Emissions Control Unit (ECU) for processing. The bonnets enclose a volume above and/or around the exhaust pipes and the compliant bumper closes against the internal or external surface of the exhaust pipe or pipes or against the top surface of the locomotive surrounding the exhaust pipe or pipes. The closing prevents or limits outside air from entering the bonnet and the exhaust gases from being emitted to the atmosphere.

26 Claims, 11 Drawing Sheets

EXHAUST INTAKE BONNET FOR CAPTURING EXHAUSTS FROM DIESEL-POWERED LOCOMOTIVES

BACKGROUND OF THE INVENTION

The present invention relates to capturing exhaust gases and in particular to a bonnet for capturing exhaust gases from a railroad locomotive at rest or in motion at a slow speed.

Railroad locomotives generally have a large diesel engine coupled to a generator which provides power to drive motors attached to the locomotive's wheels. For example, a General Motors FP 59 diesel electric locomotive has a 12 cylinder main diesel engine producing approximately 3200 hp. The FP 59 locomotive also includes a second smaller 12 cylinder diesel engine for providing electricity for air conditioning, lights, kitchen facilities, and other auxiliary requirements of a train.

Substantial quantities of pollutants are produced by locomotives burning diesel fuels. The exhaust produced by an engine burning these fuels is a complex mixture of tens of thousands of gases and fine particulates. The particulates, which make up the commonly observed discharges known as soot or smoke, contain more than forty toxic air contaminants. The exhaust may include arsenic, benzene, and formaldehyde along with other ozone-forming pollutants that are components of smog and acid rain, such as sulfur dioxide ($SO_2$) and nitrogen oxides (NOx). Such contaminates create a substantial health risk to railroad workers and residents of surrounding communities and may physically damage structures and equipment.

Studies of diseases and health problems tied to air-borne pollutants, including various forms of cancer, have identified geographic clusters with occurrences of such diseases and health problems significantly higher than statistical norms. These geographic clusters have been shown to conform closely to the geographic distribution of emissions plumes from railroad yards and test facilities. Although these health issues have been identified, there is presently no effective system for capturing locomotive emissions in these areas.

BRIEF SUMMARY OF THE INVENTION

The present invention addresses the above and other needs by providing a bonnet which captures exhaust gases from the exhaust pipes of diesel-powered locomotives. The bonnet includes a shell with a compliant fender. One or more of the bonnets are positioned over the exhaust pipe or pipes of the locomotive and are secured to the exhaust pipes or to a top surface of the locomotive. The bonnets are connected to a manifold, and the manifold carries the exhaust gasses to an Emissions Control Unit (ECU) for processing. The bonnets enclose a volume above and/or around the exhaust pipes and the compliant fender closes against the internal or external surface of the exhaust pipe or pipes or against the top surface of the locomotive surrounding the exhaust pipe or pipes. The closing prevents or limits outside air from entering the bonnet and the exhaust gases from being emitted to the atmosphere.

In accordance with one aspect of the invention, there is provided a bonnet for use with a system for processing diesel locomotive exhaust. The system further includes an Emissions Control Unit (ECU) for processing locomotive exhaust and a manifold connected to the bonnet for carrying the exhaust from the bonnet to the ECU. The bonnet includes a shell for enclosing a volume around a locomotive exhaust pipe, a fender for closing out outside air, and a telescoping or compressing duct for allowing the bonnet to be lowered against a locomotive and raised away from the locomotive. The shell may include a compliant fender for closing out outside air from the shell and electromagnets may be included in the shell for holding the compliant fender against a roof of the locomotive.

In accordance with another aspect of the invention, there is provided a system for processing diesel locomotive exhaust. The system includes an Emissions Control Unit (ECU) for processing locomotive exhaust, a bonnet for capturing the locomotive exhaust, and a manifold connected to the bonnet for carrying the exhaust from the bonnet to the ECU. The manifold includes at least one parallel duct running parallel to train tracks and a connecting duct connecting the at least one parallel duct to the ECU. The parallel duct is supported by an overhead structure and is preferably approximately centered over the train tracks. The parallel duct includes a slot (or bottom gap) along the bottom of the parallel duct and running the length of the parallel duct. Seals reside along the slot and ordinarily close the slot to prevent the escape of exhaust or the entry of outside air. The bonnet includes a vertical duct connected to a duct transport unit slidably residing in or on the parallel duct, or connected to an extendable inner duct carried within the parallel duct. The duct transport unit is adapted to slide along the parallel duct and to open the seal as the duct transport unit slides to allow for motion of the locomotive. The extendable inner duct extends and retracts within the parallel duct to allow for motion of the locomotive.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

Figure 1:
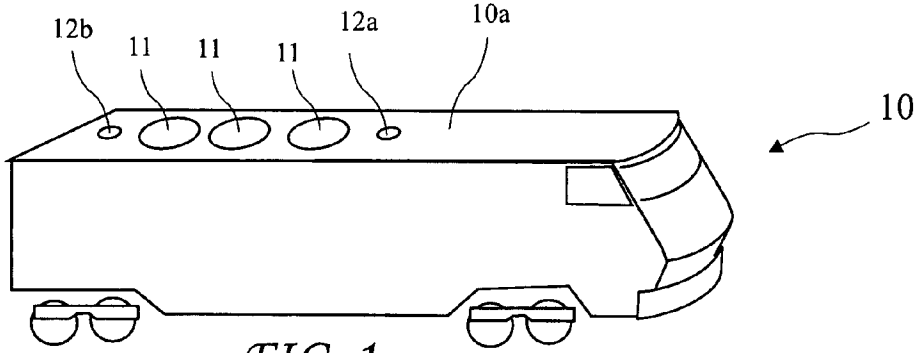
FIG. 1 is a locomotive suitable for use with the present invention.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

The present invention comprises a bonnet for capturing diesel locomotive exhaust, and a system including the bonnet for capturing and processing the diesel exhaust. Recent studies of diseases and health problems tied to air-borne pollutants, including various forms of cancer, have identified geographic clusters with occurrences of such diseases and health problems significantly higher than statistical norms. These geographic clusters have been shown to conform closely to the geographic distribution of emissions plumes from railroad yards and test facilities. The present invention addresses a need for controlling emissions from diesel locomotives while stationary or moving slowly within a rail yard with engines idling or operating at low power (Notch 2) or while stationary in a locomotive test facility and operating at low or full power (to Notch 8) during load testing. By capturing and processing most or all of the exhaust gases for subsequent treatment, the exhaust intake bonnet and exhaust processing system of the present invention permits a significant reduction of particulate matter (PM), nitrogen oxides (NOx), sulfur dioxide ($SO_2$) and volatile organic compounds (VOCs). The present invention may further be utilized to reduce locomotive emissions resulting from port side loading and unloading of containers onto railcars at seaports, or from any activity wherein a locomotive resides in a small area for periods or time with the locomotive engine(s) running.

A similar problem is the emissions from ocean going vessels. U.S. patent application Ser. No. 10/835,197, filed Apr. 29, 2004 for "Maritime Emissions Control System," and assigned to the assignee of the present invention, describes a maritime emissions control system which may be transported by barge or vessel to an Ocean Going Vessel (OGV) near or within a harbor. The maritime emissions control system captures and processes a main exhaust flow from the OGV to reduce emissions. The main exhaust flow may be from the OGV's engine(s), auxiliary engines, generators, and/or any other source of exhaust from the OGV. The '197 application is herein incorporated by reference.

U.S. patent application Ser. No. 10/941,731, filed Sep. 14, 2004 for "High Thermal Efficiency Selective Catalytic Reduction (SCR) System," and assigned to the assignee of the present invention, describes an emissions control unit which transfers heat generated in one or more parts of the SCR system which generate heat to other parts of the SCR system which require heat. For example, heat stored in exhaust from a diesel generator is used to convert urea to ammonia used by the SCR system, and/or the diesel generator exhaust may be used to heat the main exhaust flow before entry into the SCR system. Additionally, a heat exchanger is used to transfer heat from a hot clean flow out of the SCR system to the main exhaust flow entering the SCR system. The '731 application is herein incorporated by reference.

US Patent Application filed on Mar. 28, 2005 titled "Air Pollution Control System for Ocean-Going Vessels," and assigned to the assignee of the present invention, describes an emissions control unit having a first system adapted to receive a dirty flow and reduce Particulate Matter (PM) and Sulfur Dioxide ($SO_2$) in the dirty flow to produce a first processed flow from the first system and a second system adapted to receive the first processed flow and to reduce Oxides of Nitrogen ($NO_x$) in the first processed flow to produce a second processed flow from the second system. The first system and the second system are connected to serially process a gaseous flow to reduce PM, $SO_2$, and $NO_x$ in the flow, and by first reducing the PM, $SO_2$ before the flow enters the $NO_x$ reducing system, the reliability and efficiency of the $NO_x$ reducing system is improved. The system further teaches the use of heat in exhaust from a diesel generator to convert aqueous ammonia, or urea, to ammonia for a selective catalytic reducer, thus reducing energy costs. The application filed Mar. 28, 2005 is herein incorporated by reference.

The present invention applies similar principles as described in the above incorporated patent applications to the control of emissions from a diesel locomotive 10 as shown in FIG. 1. The locomotive 10 has at least one exhaust pipe 12*a* for a main engine, and generally has a second exhaust pipe 12*b* for an auxiliary engine, for example, for supplying power to train cars. Such locomotives 10 may produce a large volume of diesel exhaust while operating. When the locomotive 10 is traveling between destinations the diesel exhaust may be diluted into the air. However, when the diesel locomotive 10 is parked or moving slowly at a train station, at a port or other loading/unloading location, or at a test facility, a large amount of diesel exhaust may be released into a smaller area and present a health risk. This problem is compounded by the fact that locomotive engines are often left running for long periods of time versus stopping and restarting the engines.

Figure 2:
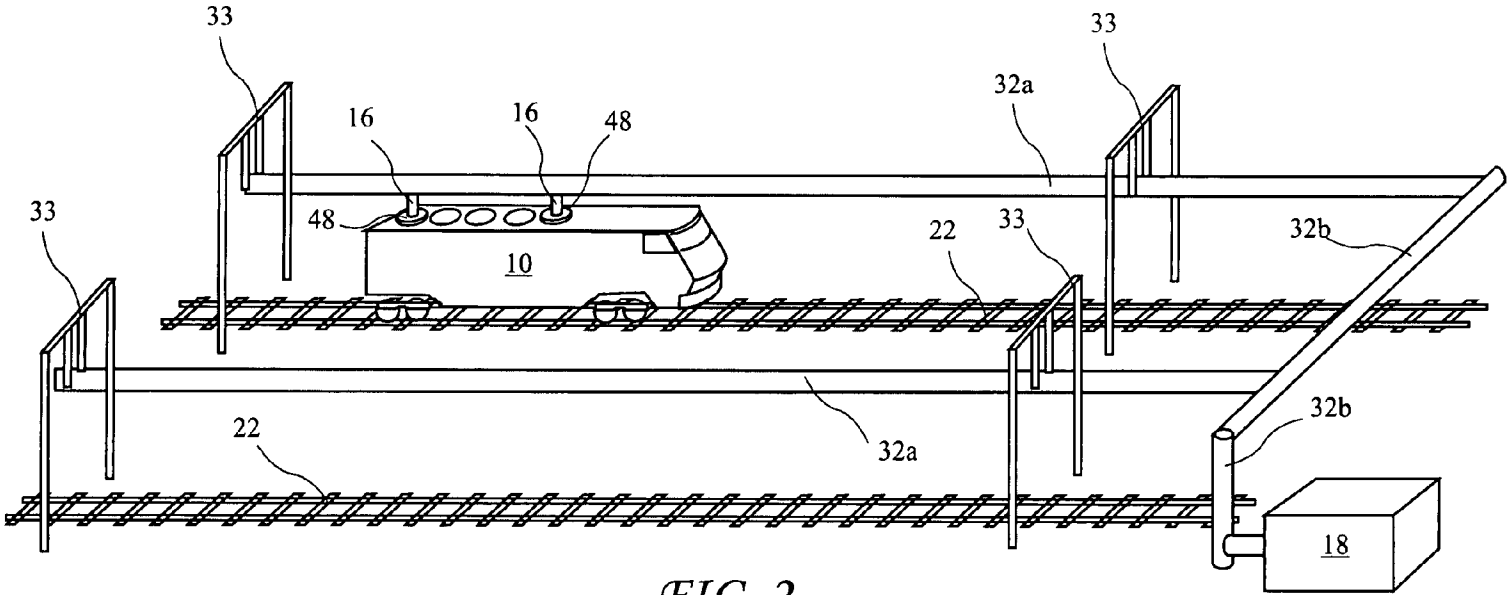
FIG. 2 depicts a manifold system according to the present invention for collecting locomotive exhaust and carrying the exhaust to an Emissions Control Unit (ECU).

A system according to the present invention for capturing and processing diesel locomotive exhaust is shown in FIG. 2. The system includes a bonnet 48 (see FIGS. 7 and 10), an Emissions Control Unit (ECU) 18, and a manifold for carrying the locomotive exhaust from the bonnet 48 to the ECU 18. The manifold comprises a system of parallel ducts 32*a* and connecting ducts 32*b*. The parallel ducts 32*a* and/or the connecting ducts 32*b* are preferably supported by an overhead structure 33. The parallel ducts 32*a* run parallel to train tracks 22, are preferably approximately centered above the train tracks 22, and are high enough to allow the diesel locomotive 10 to run under the parallel ducts 32*a*. Each parallel duct 32*a* includes a slot (or bottom gap) 84 (see FIGS. 18A-18F) running along (or parallel to) it's bottom and running substantially (may not extend to ends) the length of the parallel duct 32*a*, and means for containing the captured exhaust in the parallel duct. The bonnet 48 includes or is attached to a telescoping vertical duct 16 (preferably comprising a flexible duct 16 within vertical duct supports 50*a* and 50*b* shown in FIG. 8) or a flexible vertical duct 70 (see FIG. 10). The vertical duct 16 or 70 is connected to a duct transport unit 82 slidably residing in the parallel duct 32*a* (see FIGS. 18B, 18D,19, and 20), or connected to an extendable inner duct 86 (see FIGS. 18F, and 21). The duct transport unit 82 is adapted to slide inside the at least one parallel duct 32*a* and to open a seal 80 or 81 (see FIGS. 18B and 18D) as the duct transport unit slides past, wherein the seal 80, 81 closes behind the duct transport unit to allow for motion of the locomotive 10. The extendable inner duct 86 extends and retracts within the parallel duct to allow for motion of the locomotive 10.

Figure 3:
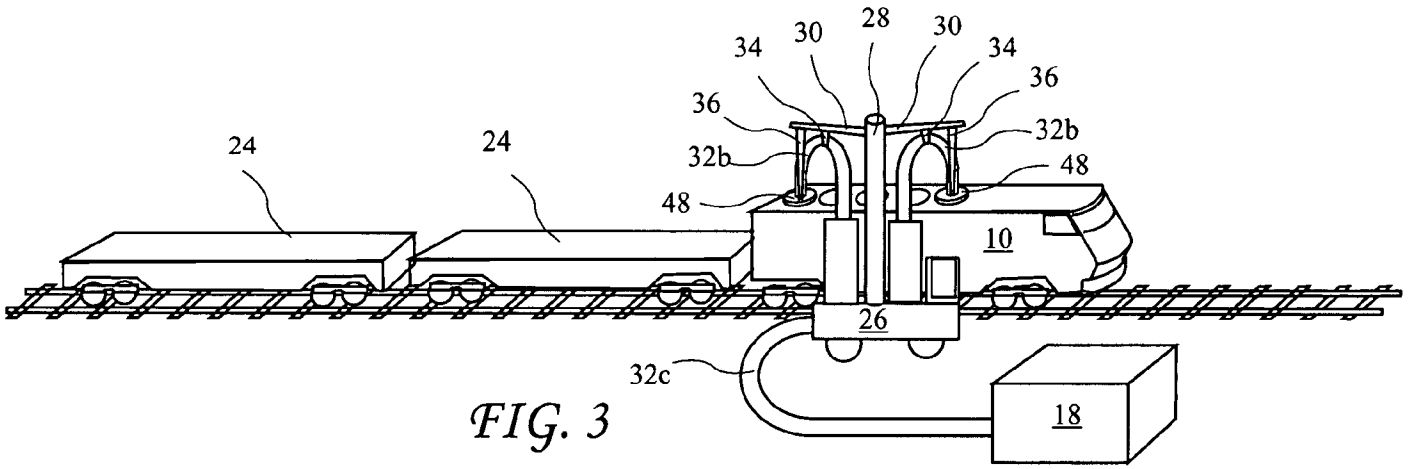
FIG. 3 shows a truck based manifold system according to the present invention for collecting locomotive exhaust and carrying the exhaust to an ECU.

A second embodiment of the system according to the present invention for capturing and processing diesel locomotive exhaust is shown in FIG. 3. The second embodiment includes a truck 26 carrying a tower 28 and connecting ducts 32*b*. Arms 30 extend from the tower 28 and duct supports 34 are attached to the arms 30. Bonnet supports 36 also are attached to the arms 30. The duct supports 34 support the connecting ducts 32*b* and the bonnet supports 36 support and position the bonnets 48 over the exhaust pipes 12*a* and 12*b* (see FIG. 1). A flexible duct 32*c* is connected between the truck 26 and the ECU 18. The connecting ducts 32*b* carry the diesel exhaust from the diesel locomotive 10 to the truck 26, and the flexible duct 32*c* carries the diesel exhaust from the truck 26 to the ECU 18.

Figure 4:
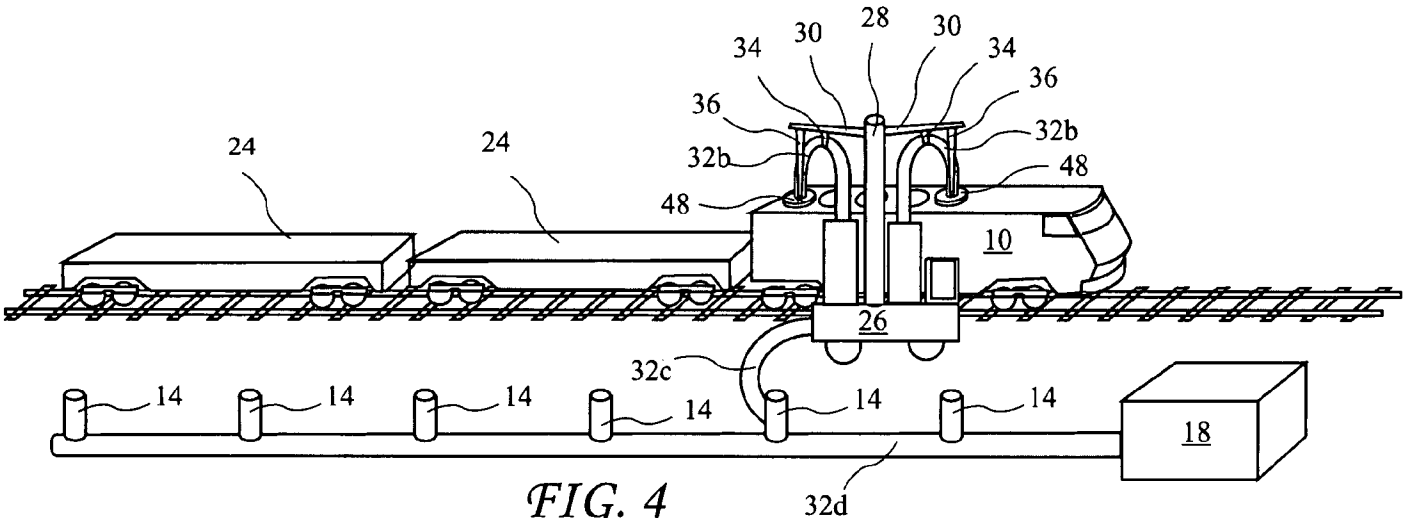
FIG. 4 is a truck based manifold system according to the present invention for collecting locomotive exhaust and carrying the exhaust to a parallel duct connected to an ECU.

A third embodiment of the system according to the present invention for capturing and processing diesel locomotive exhaust is shown in FIG. 4. The third embodiment includes the truck 26 carrying the tower 28 and the connecting ducts 32*b*. The arms 30 extend from the tower 28 and duct supports 34 are attached to the arms 30. The bonnet supports 36 also are attached to the arms 30. The duct supports 34 support the connecting ducts 32*b* and the bonnet supports 36 support and position the bonnets 48 over the exhaust pipes 12*a* and 12*b* (see FIG. 1). A second parallel duct 32*d* resides substantially parallel and to the side of the train tracks 22, and is connected to the ECU 18. The parallel duct 32*d* includes spaced apart hubs 14. A flexible duct 32*c* is connected between the truck 26 and one of the hubs 14. The connecting ducts 32*b* carry the diesel exhaust from the diesel locomotive 10 to the truck 26, the flexible duct 32*c* carries the diesel exhaust from the truck 26 to the hub 14, and the parallel duct 32*d* carries the diesel exhaust to the ECU 18. The third embodiment may accommodate applications where the locomotive 10 is stationary and operating under low or full power such as in a locomotive test stand or facility.

Figure 5:
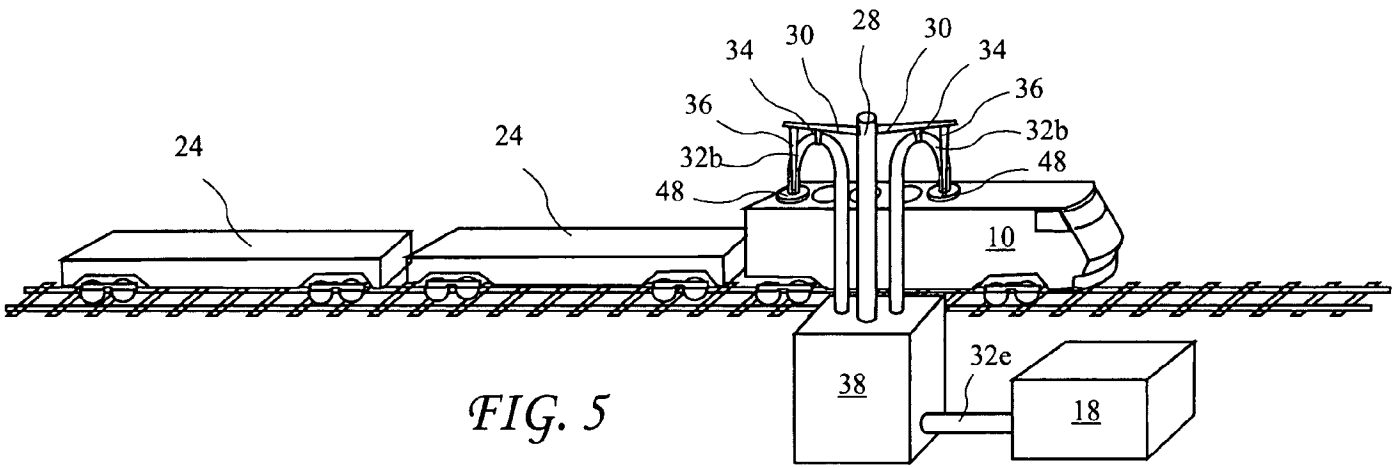
FIG. 5 shows a stationary manifold system according to the present invention for collecting locomotive exhaust and carrying the exhaust to an ECU.

A fourth embodiment of the system according to the present invention for capturing and processing diesel locomotive exhaust is shown in FIG. 5. The fourth embodiment includes a base unit 38 supporting the tower 28 and the connecting ducts 32*b*. The arms 30 extend from the tower 28 and duct supports 34 are attached to the arms 30. The bonnet supports 36 also are attached to the arms 30. The duct supports 34 support the connecting ducts 32*b* and the bonnet supports 36 support and position the bonnets 48 over the exhaust pipes 12*a* and 12*b* (see FIG. 1). A fixed duct 32*e* is connected between the base unit 38 and the ECU 18, or the ECU 18 may reside next to the base unit 38, or be integrated into the base unit 38. The connecting ducts 32*b* carry the diesel exhaust from the diesel locomotive 10 to the base 38, and the fixed duct 32*e* carries the diesel exhaust from the base 38 to the ECU 18. The fourth embodiment may accommodate applications where the locomotive 10 is stationary and operating under low or full power such as in a locomotive test stand or facility.

Figure 6:
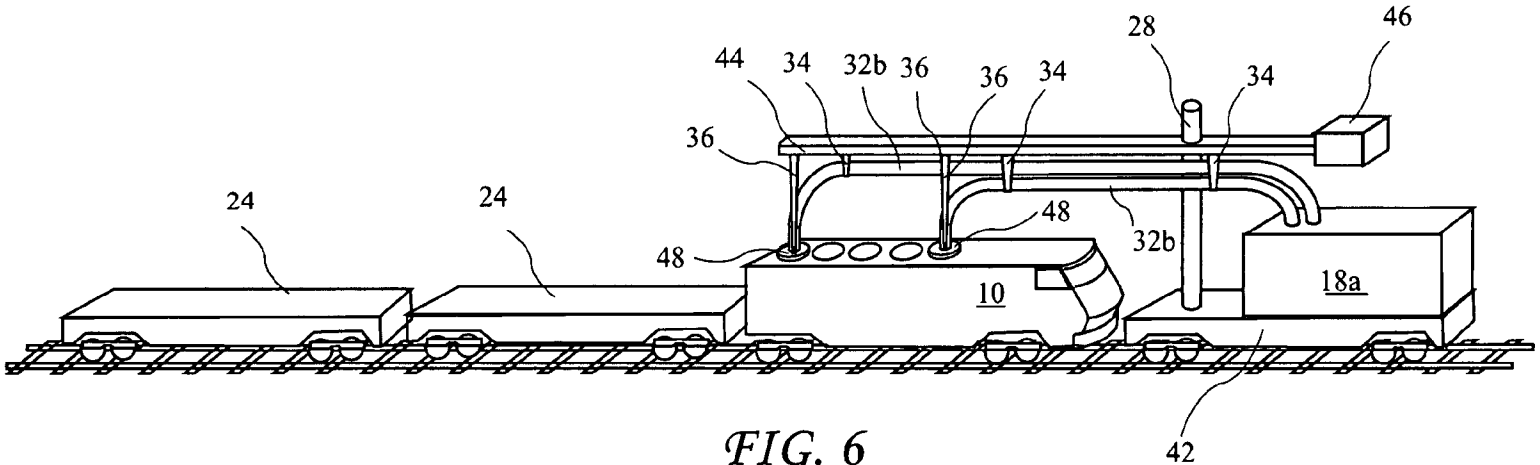
FIG. 6 shows a mobile rail car based system according to the present invention for collecting locomotive exhaust and carrying the exhaust to an ECU mounted on the rail car.

A fifth embodiment of the system according to the present invention for capturing and processing diesel locomotive exhaust is shown in FIG. 6. The fifth embodiment includes an ECU rail car 42 supporting the tower 28 and a boom 44. The boom 44 may be pivotally or flexibly mounted to the tower 28 to allow for relative motion between the ECU rail car 42 and the locomotive 10. The boom 44 is counter balanced by a counter weight 46. The boom 44 extends over the locomotive 10 and duct supports 34 and bonnet supports 36 are attached to the boom 44. The duct supports 34 support the connecting ducts 32*b* and the bonnet supports 36 support and position the bonnets 48 over the exhaust pipes 12*a* and 12*b* (see FIG. 1). The connecting ducts 32*b* carry the diesel exhaust from the diesel locomotive 10 to a second ECU 18*a* adapted to reside on the ECU rail car 42.

Figure 7:
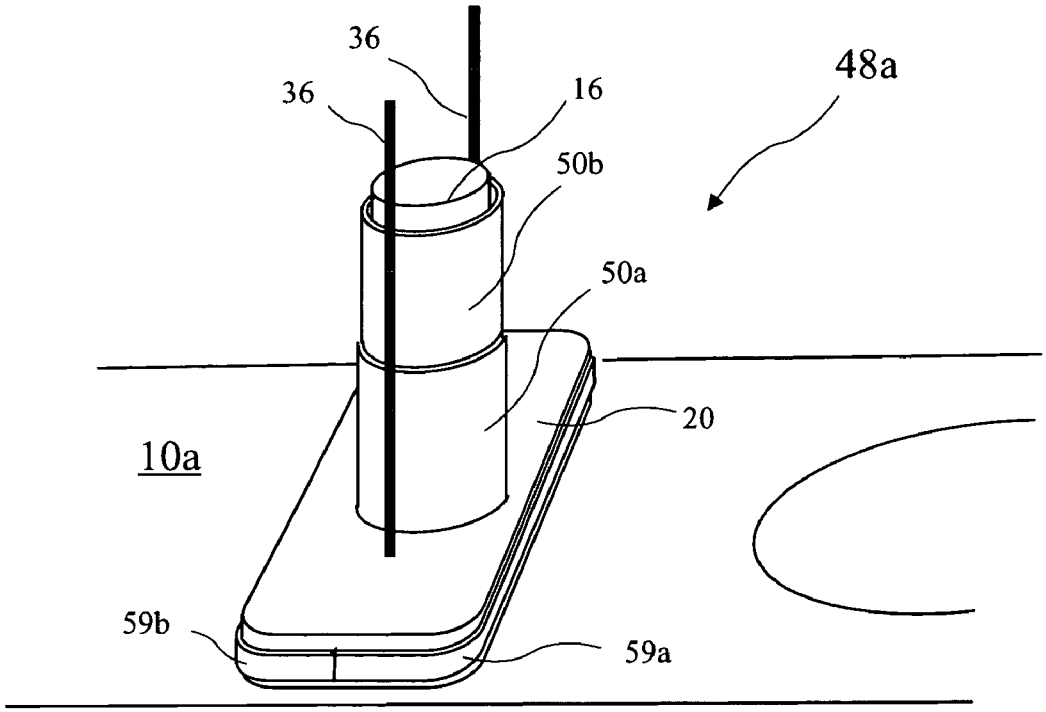
FIG. 7 is a perspective view of a first embodiment of a bonnet for collecting locomotive exhaust according to the present invention.

A perspective view of a first bonnet 48*a* is shown in FIG. 7. Vertical duct supports 50*a* and 50*b* support the vertical duct 16. Bonnet supports 36 are attached to the shell 20 for raising and lowering the bonnet 48*a*. The bonnet supports 36 may include, for example, cables, lever arms, gear mechanisms, and/or hydraulic mechanisms and are preferably cable. The vertical duct supports 50*a* and 50*b* are preferably telescoping structures. Contract members 59*a* and 59*b* cooperate to adjust the size of the shell 20. A side view of the bonnet 48*a* is shown in FIG. 7A.

Figure 7A:
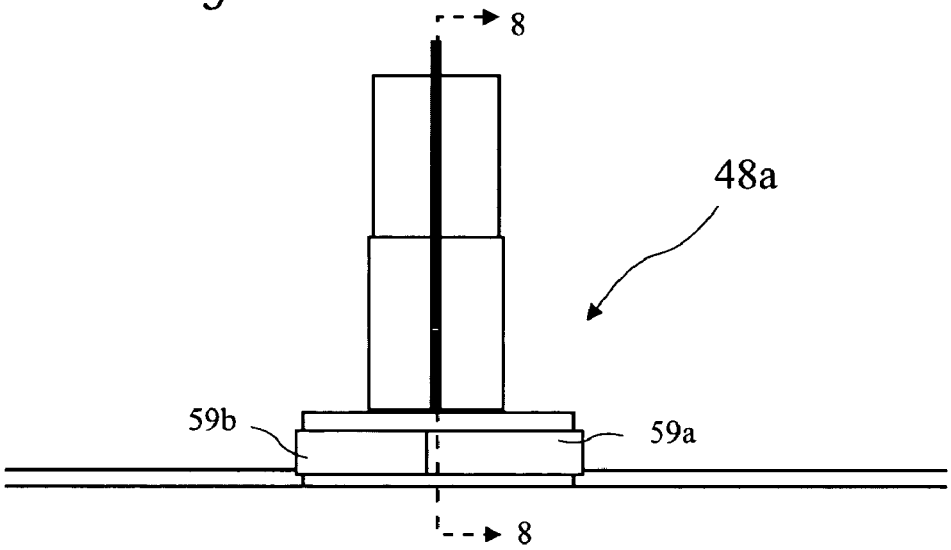
FIG. 7A is a side view of the first bonnet.
Figure 7B:
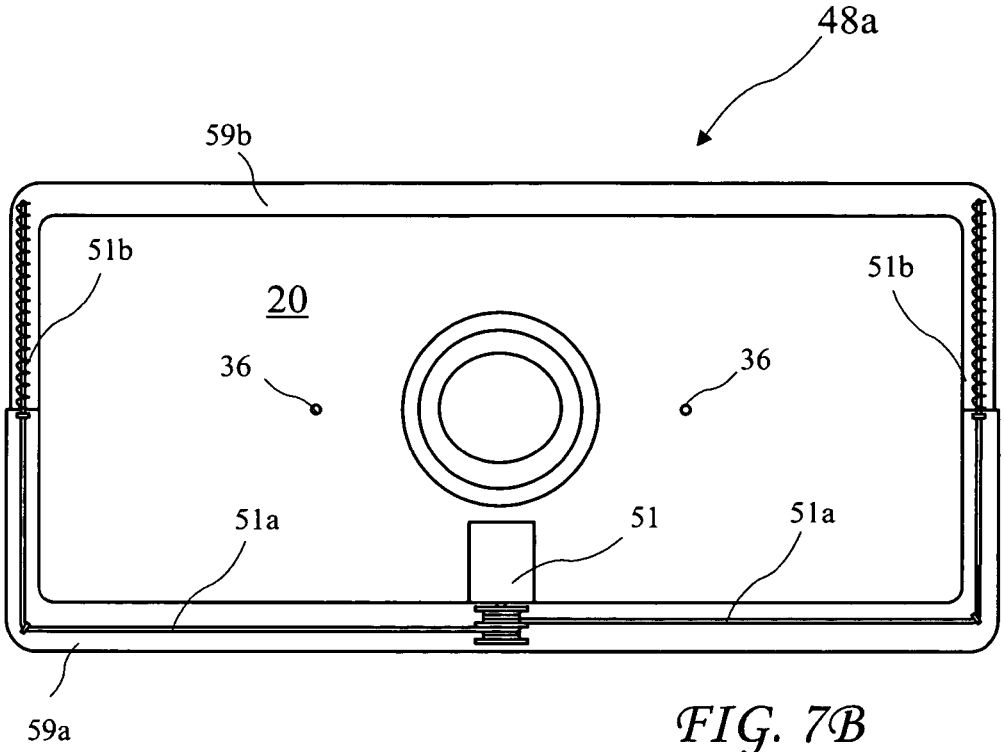
FIG. 7B is a top view of the first bonnet and bonnet adjusting apparatus.
Figure 7C:
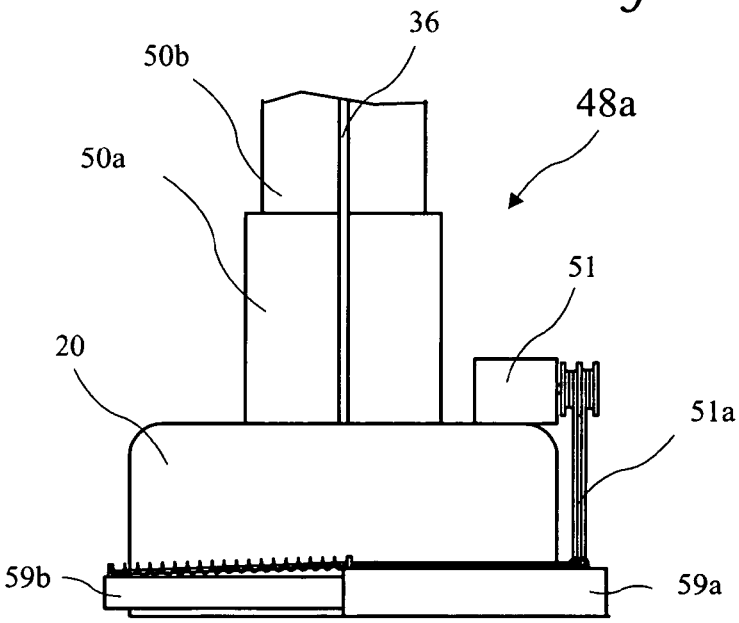
FIG. 7C is a side view of the first bonnet and the bonnet adjusting apparatus.

A top view of the first bonnet 48*a* and shell 20 adjusting apparatus is shown in FIG. 7B and a side view of the first bonnet 48*a* and the shell 20 adjusting apparatus is shown in FIG. 7C. The shell adjusting apparatus includes a shell adjustment winch with split drums 51 mounted above the contracting members 59*a* and 59*b*. A shell adjustment cable 51*a* is drawn or released by operation of the winch 51. The cable 51*a* is attached to both contracting members 59*a* and 59*b* and draws the contracting members 59*a* and 59*b* together to reduce the shell 20 size and to compress springs 51*b*. The springs 51*b* operate to expand the shell 20 when the cable 51*a* is released by the winch 51, thus urging the shell 20 to a larger size.

Figure 8:
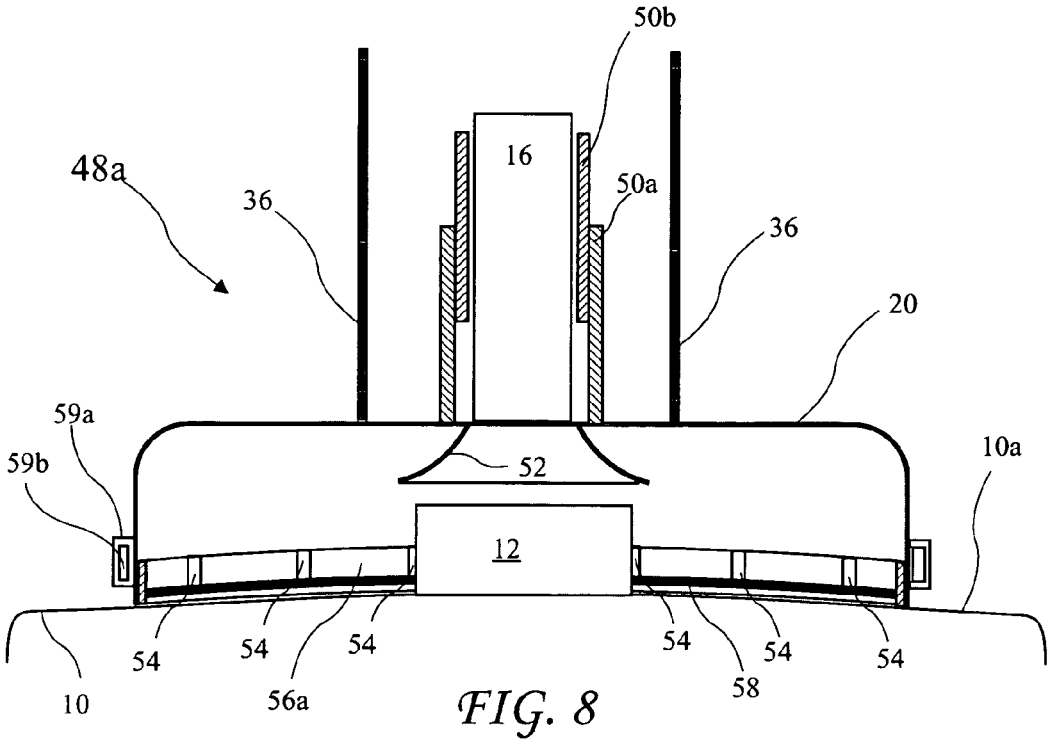
FIG. 8 is a cross-sectional view of the first bonnet taken along line 8-8 of FIG. 7A.

A cross-sectional view of the bonnet 48*a* taken along line 8-8 of FIG. 7A is shown in FIG. 8. The bonnet 48*a* includes the shell 20 for enclosing a volume around the locomotive exhaust pipe 12*a* or 12*b* (see FIG. 1). A lower edge of the shell includes a first fender (or bumper) 56*a* for closing against a top surface (or roof 10*a*) of the locomotive 10, against an inside surface of one of the exhaust pipes 12*a* or 12*b*, or against an outside surface of one of the exhaust pipes 12*a* or 12*b*. The fender 56*a* preferably is made from a compliant matrix (e.g., sponge like) material, and more preferably made of a high-temperature silicon foam, encasing a structural member 58 preferably made of carbon-reinforced epoxy or ester or of spring steel. The fender 56*a* surrounds and captures the flexible structural member 58 and the electromagnets 54 and is sufficiently compliant so as to conform to the shape of the locomotive's roof 10*a*. The fender 56*a* also serves to close against the roof 10*a*.

Contracting members 59*a* and 59*b* residing around the perimeter of the shell 20 may be contracted or adjusted to vary the size and/or shape of the shell 20 to accommodate various exhaust tube sizes and various extents of free-space fore and aft of the exhaust pipes 12*a* and 12*b*. The adjustment of size and/or shape of the shell 20 may be accomplished by compressing compliant walls of the shell 20 or by sliding surfaces in end panels of the shell 20 which telescope past one another, or by a combination of compliant walls and telescoping end panels. The bonnet 48*a* may be held in place by one or more of gravity, friction, mechanical means or electro-magnetic force, and is preferably held in place by electro-magnets 54.

The vertical duct 16 is attached to the shell 20 to carry diesel exhaust captured by the shell 20 to the parallel duct 32*a* (see FIG. 2) or to the connecting duct 32*b* (see FIG. 3, 4, 5, or 6). The vertical duct 16 is preferably extendable and retractable to allow raising and lowering of the bonnet 48*a*, and is more preferably a telescoping or a stretching duct to allow extension and retraction. An air foil 52 may be included to manage the orderly channeling of the flow of exhaust into the vertical duct 16. The air foil 52 preferably resides at the entry into the vertical duct 16, and flairs down and outward from the vertical duct 16. The vertical duct used with the bonnet 48*a* may alternatively be a flexible vertical duct 70 (see FIG. 10).

Figure 9:
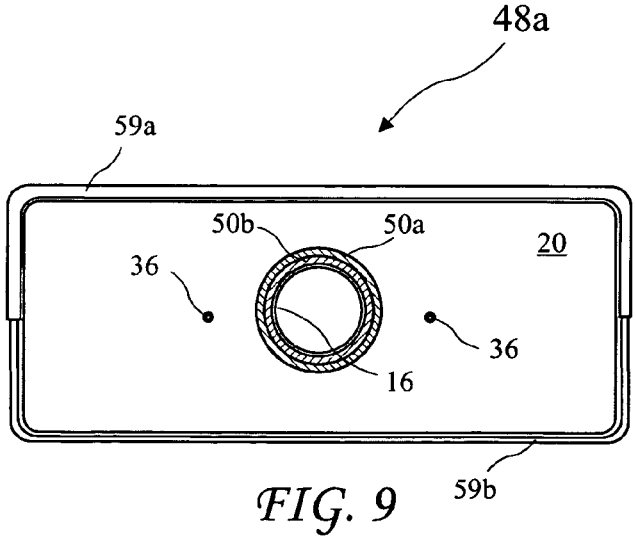
FIG. 9 is a top view of the bonnet.

A top view of the bonnet 48*a* is shown in FIG. 9. The contracting member 59 may comprise telescoping members 59*a* and 59*b* which cooperate to adjust the perimeter of the shell 20.

Figure 10:
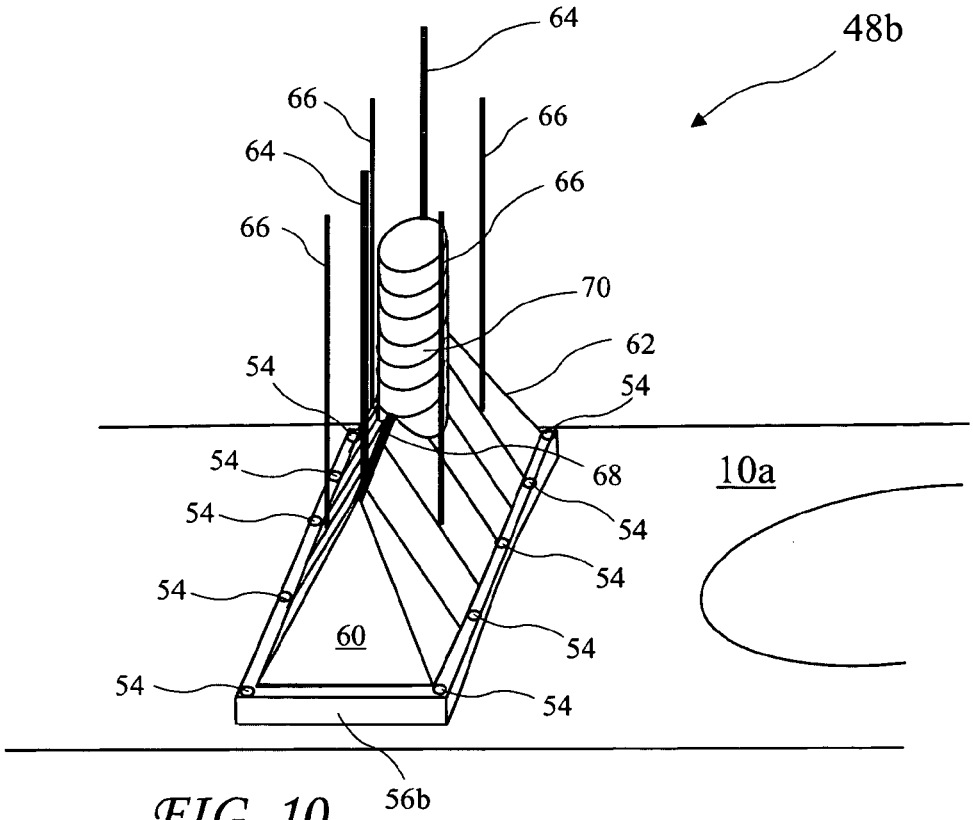
FIG. 10 is a perspective view of a second embodiment of a bonnet according to the present invention.

A perspective view of a second embodiment of a bonnet 48*b* according to the present invention is shown in FIG. 10. The bonnet 48*b* comprises a tent 60 formed over and/or attached to a frame 62. The frame 62 is connected to a hinge 68 preferably running along the peak of the frame. First cables 64 are attached to the hinge 68 and second cables 66 are attached to the frame 62 to provide vertical support to the hinge 68 and the frame 62 independently. The cables 64, 66 may be independently raised and lowered, thereby causing the frame 62 to pivot about the hinge 68, thereby widening and narrowing the frame 62. A second compliant fender 56*b* resides on a lower edge of the tent 60. The tent 60 and the fender 56*b* follow the widening and narrowing the frame 62 thereby widening and narrowing the tent 60 to accommodate the locomotive 10. Magnets 54 reside in the fender 56*b* or in the base of the tent 60 to hold the bonnet 48*b* in place on the locomotive 10. A side view of the bonnet 48*b* is shown in FIG. 10A.

Figure 10A:
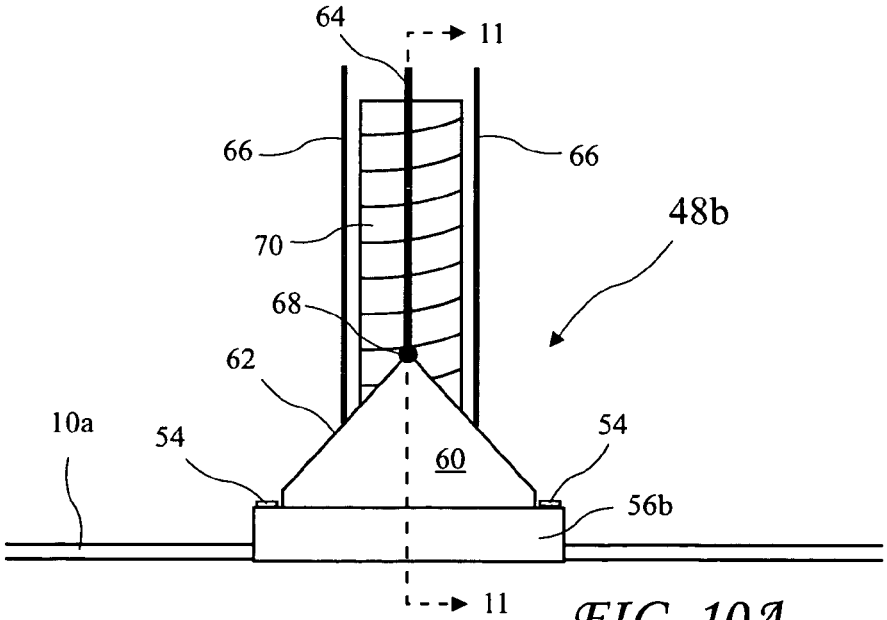
FIG. 10A is a side view of the second embodiment of the bonnet.
Figure 11:
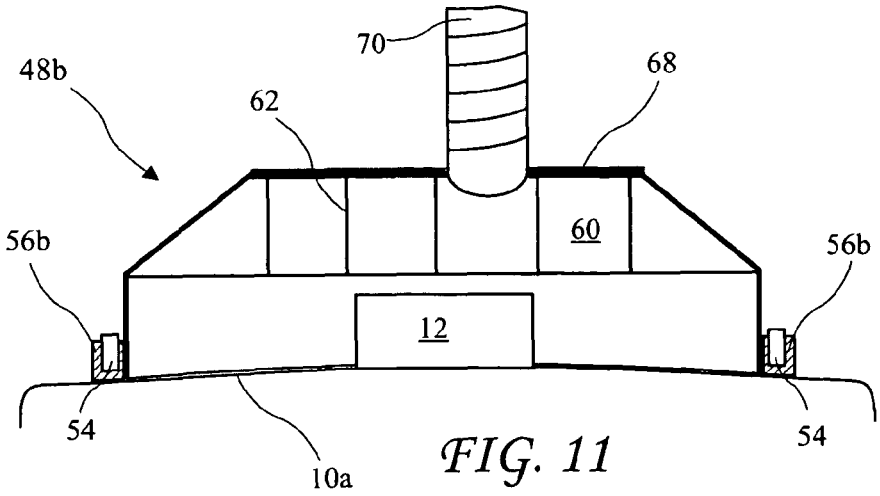
FIG. 11 is a cross-sectional view of the second bonnet taken along line 11-11 of FIG. 10A.
Figure 12:
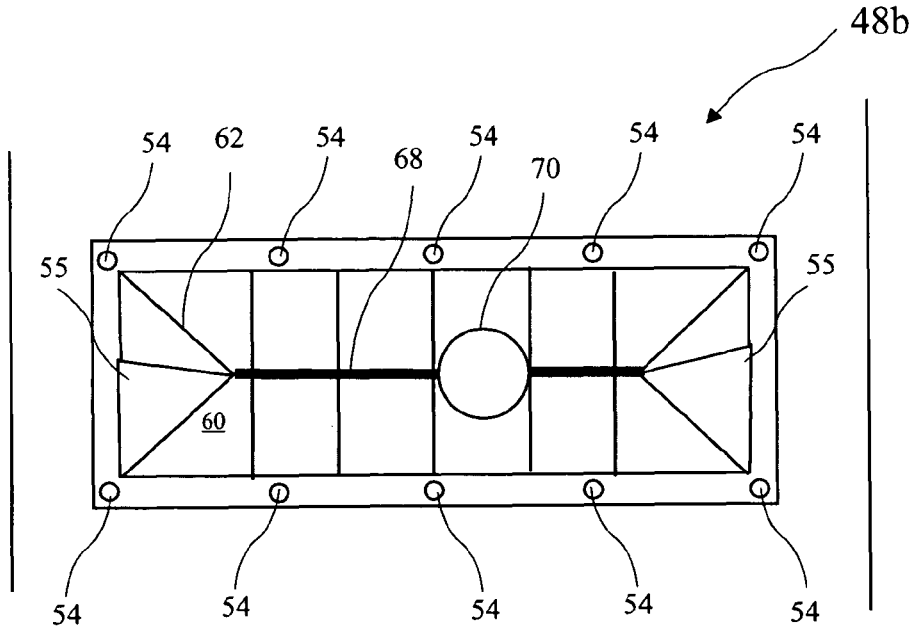
FIG. 12 is a top view of the second bonnet.
Figure 13A:
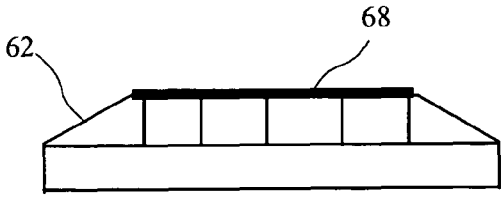
FIG. 13A is a side view of a frame and hinge of the bonnet.
Figure 13B:
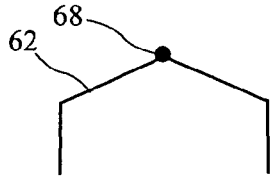
FIG. 13B is an end view of the frame and the hinge of the second bonnet.

A cross-sectional view of the bonnet 48*b* taken along line 11-11 of FIG. 10A is shown in FIG. 11. The bonnet 48*b* resides over the exhaust pipe 12, thereby capturing exhaust from the locomotive 10. A top view of the bonnet 48*b* is shown in FIG. 12. The bonnet 48*b* includes telescoping (or overlapping) portions 55 which allow the bonnet 48*b* to retain shape when the bonnet 48*b* is adjusted to different widths. A side view of the frame 62 and hinge 68 is shown in FIG. 13A, and an end view of the frame 62 and the hinge 68 is shown in FIG. 13B.

Figure 14A:
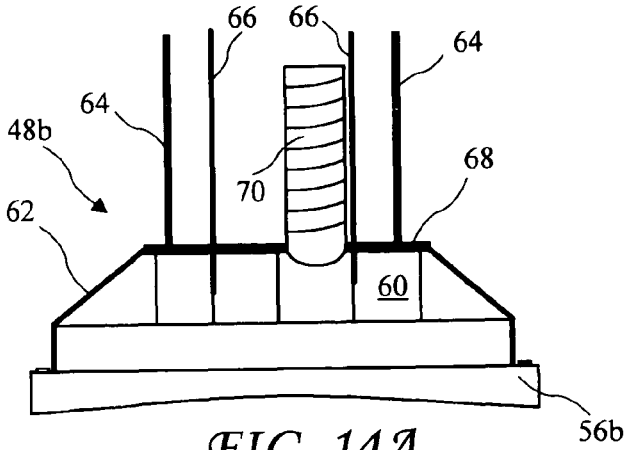
FIG. 14A is a front view of the second bonnet adjusted to a first width.
Figure 14B:
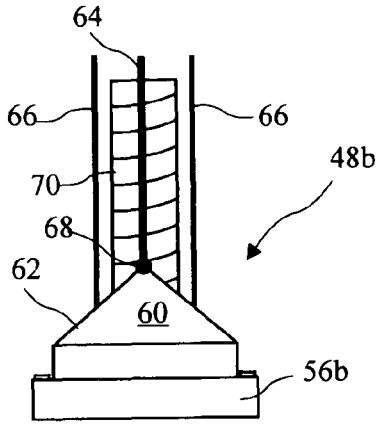
FIG. 14B is an end view of the second bonnet adjusted to the first width.
Figure 15A:
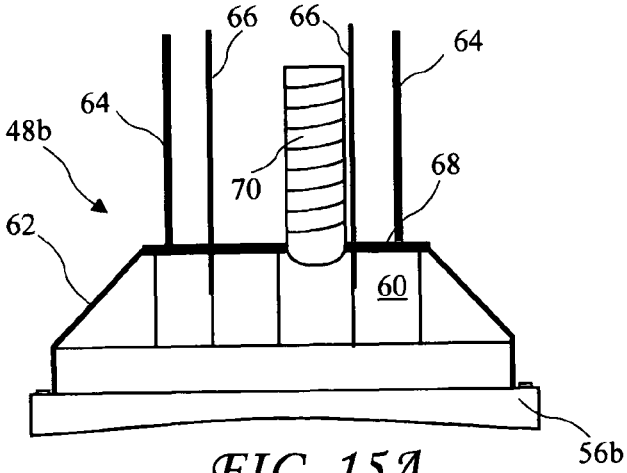
FIG. 15A is a front view of the second bonnet adjusted to a second width.
Figure 15B:
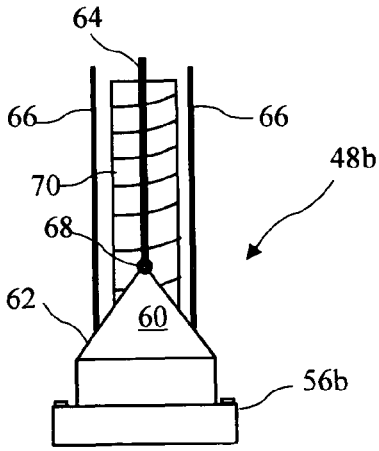
FIG. 15B is an end view of the second bonnet adjusted to the second width.
Figure 16A:
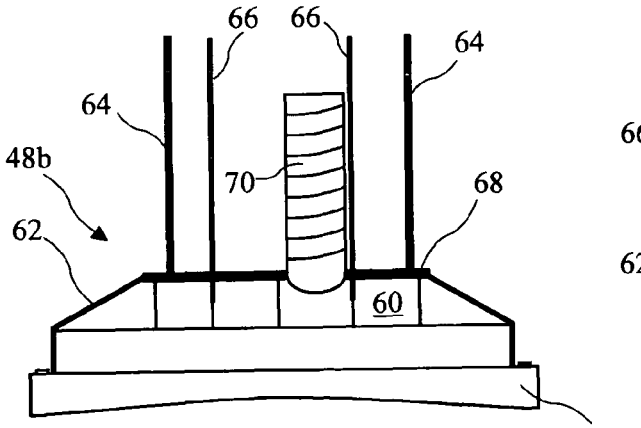
FIG. 16A is a front view of the second bonnet adjusted to a third width.
Figure 16B:
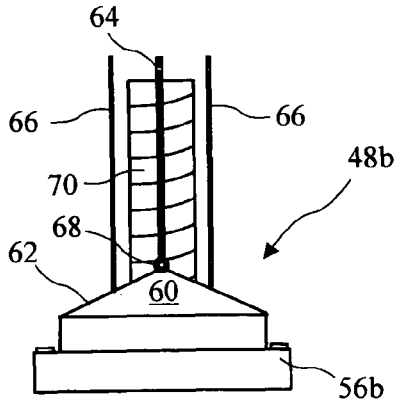
FIG. 16B is an end view of the second bonnet adjusted to the third width.

A front view of the bonnet 48*b* adjusted to a first width is shown in FIG. 14A, and an end view of the bonnet 48*b* adjusted to the first width is shown in FIG. 14B. A front view of the bonnet 48*b* adjusted to a narrower width is shown in FIG. 15A, and an end view of the bonnet 48*b* adjusted to the narrower width is shown in FIG. 15B. A front view of the bonnet 48*b* adjusted to a wider width is shown in FIG. 16A, and an end view of the bonnet 48*b* adjusted to the wider width is shown in FIG. 16B. Thus, by adjusting the cables 64 and 66, the bonnet 48*b* may be adjusted as necessary to fit various locomotives. The ends of the tent 60 and fender 56*b* may stretch, flex, or otherwise distort as necessary to allow the width of the tent 60 to be adjusted.

Figure 17:
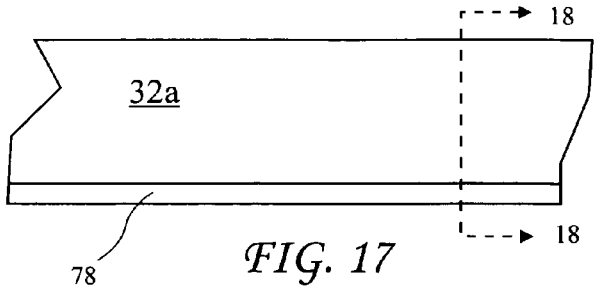
FIG. 17 is a side view of a parallel duct according to the present invention.
Figure 18A:
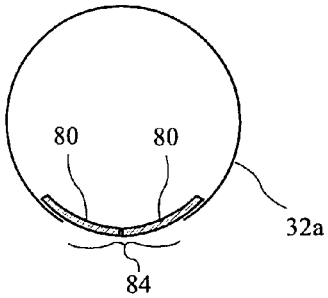
FIG. 18A is a cross-sectional view of the parallel duct with a seal closing a slot (bottom gap), taken along line 18-18 of FIG. 17.

A side view of a portion of the parallel duct 32*a* including a seal 78 is shown in FIG. 17. A cross-sectional view of the parallel duct 32*a* taken along line 18-18 of FIG. 17 is shown in FIG. 18A wherein the seal 78 comprises opposing tiles 80 closing the slot 84 of the parallel duct 32*a*. A second cross-sectional view of the parallel duct 32*a* taken along line 18-18 of FIG. 17 is shown in FIG. 18B with a duct transport unit 82 pushing the tiles 80 apart to open the slot 84 to create a moving opening for the vertical duct 16 (or 70).

Figure 18C:
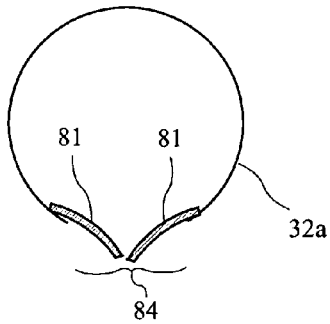
FIG. 18C is a cross-sectional view of the parallel duct with a flap closing the slot, taken along line 18-18 of FIG. 17.

A third cross-sectional view of the parallel duct 32*a* taken along line 18-18 of FIG. 17 is shown in FIG. 18C wherein the seal 78 comprises two flaps 81 which extend from the sides of the gap 84 downward and towards each other so as to normally close against each other and thereby close the gap 84. Because the pressure within the parallel duct 32*a* is preferably slightly negative, this negative pressure will tend to close the flaps 81 against each other. If any over-pressure or surge of pressure occurs in the manifold system, the flaps 81 may separate and release the pressure. The flaps 81 will separate and close against the duct transport unit 82 as it passes as shown in FIG. 18D, closing behind the duct transport unit 82 after it passes.

Figure 18E:
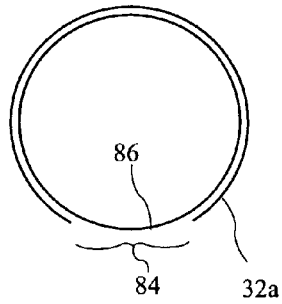
FIG. 18E is a cross-sectional view of the parallel duct with an extendable inner duct, taken along line 18-18 of FIG. 17.

A fifth cross-sectional view of the parallel duct 32*a* taken along line 18-18 of FIG. 17 is shown in FIG. 18E with a portion of an extendable inner duct 86 closing the slot 84. A sixth cross-sectional view of the parallel duct 32*a* taken along line 18-18 of FIG. 17 is shown in FIG. 18F showing a portion of the extendable inner duct 86 including the vertical duct 16 wherein the vertical duct 16 (or 70) is shown extending through the slot 84.

Figure 18B:
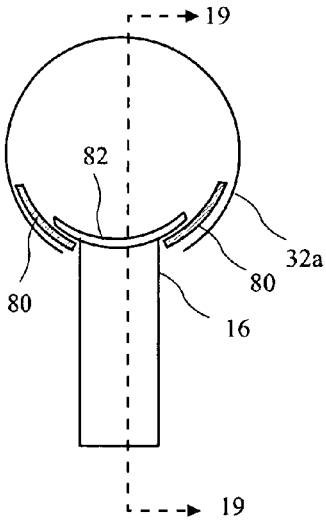
FIG. 18B is a cross-sectional view of the parallel duct with a duct transport unit opening the slot by sliding seal elements aside, taken along line 18-18 of FIG. 17.
Figure 19:
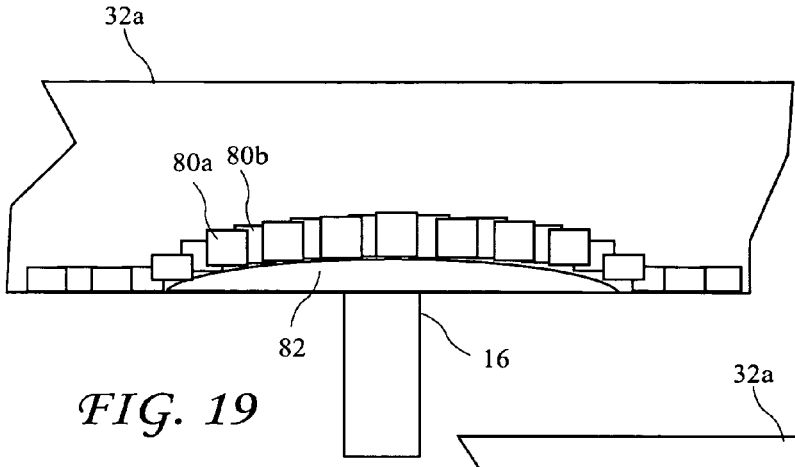
FIG. 19 is a cross-sectional view of the parallel duct taken along line 19-19 of FIG. 18B, with the duct transport unit pushing the seal open.

A cross-sectional view of the parallel duct 32*a* taken along line 19-19 of FIG. 18B is shown in FIG. 19. Interlocking tiles 80*a* and 80*b* are shown closing the slot 84 (see FIG. 18A) before and after the duct transport unit 82, and the tiles 80*a* and 80*b* are shown pushed apart by the duct transport unit 82, but sealing against the duct transport unit 82, in the portion of the parallel duct 32*a* adjacent to the duct transport unit 82. Thus, the gap 84 is closed solely by the tiles 80*a* and 80*b* before and after the duct transport unit 82, and the gap 84 is closed by the cooperation of the tiles 80*a* and 80*b* with the duct transport unit 82 in the area occupied by the duct transport unit 82. The vertical duct 16 (or 70) thereby passes between the tiles 80*a* and 80*b* and out of the parallel duct 32*a* to the bonnet 48 to capture exhaust from the exhaust pipes 12*a*, 12*b*. Thus, the parallel duct 32*a* allows motion of the duct transport unit 82 within the parallel duct 32*a* while preventing the exhaust from escaping to the atmosphere or outside air from entering the parallel duct 32*a*. Channels may be located within the duct transport unit 82 to constrain outward and inward movement of the tiles 80*a* and 80*b*. The channels may direct pins or wheels attached to the tiles.

Figure 18D:
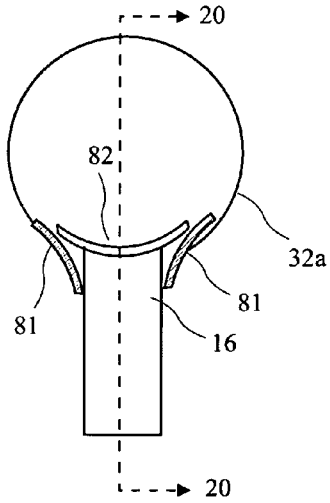
FIG. 18D is a cross-sectional view of the parallel duct with the duct transport unit opening the slot by sliding the flap aside, taken along line 18-18 of FIG. 17.
Figure 20:
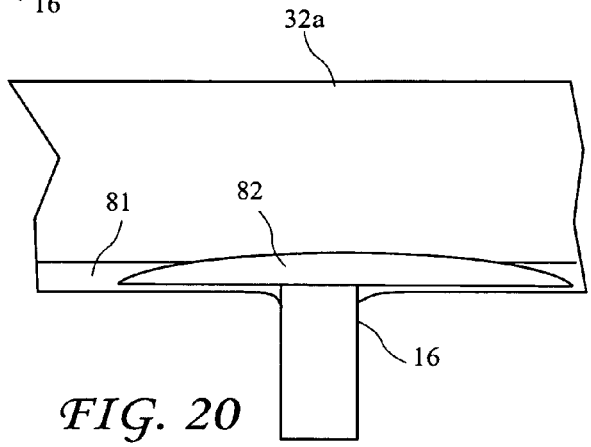
FIG. 20 is a cross-sectional view of the parallel duct taken along line 20-20 of FIG. 18D, with the duct transport unit pushing the flap open.

A cross-sectional view of the parallel duct 32*a* taken along line 20-20 of FIG. 18D is shown in FIG. 20. The flaps 81 are closed against each other to close the slot 84 before and after the duct transport unit 82 (see FIG. 18C), and are spread apart but closed against the duct transport unit 82 in the area adjacent to the duct transport unit 82. The vertical duct 16 (or 70) thereby extends out of the parallel duct 32*a* to the bonnet 48 to capture exhaust from the exhaust pipes 12*a*, 12*b*. Thus, the parallel duct 32*a* allows motion of the duct transport unit 82 within the parallel duct 32*a* while preventing the exhaust from escaping to the atmosphere or outside air from entering the parallel duct 32*a*.

Figure 18F:
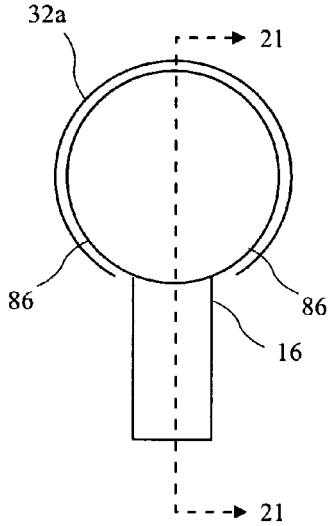
FIG. 18F is a cross-sectional view of the parallel duct with a vertical duct extending from the extendable inner duct, taken along line 18-18 of FIG. 17.
Figure 21:
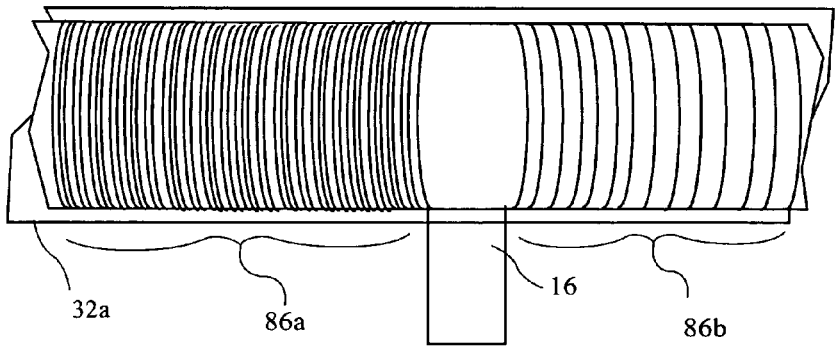
FIG. 21 is a cross-sectional view of the parallel duct taken along line 21-21 of FIG. 18F, with sections of the extendable inner duct compressed or extended to accommodate the location and/or motion of the locomotive, and the vertical duct extending into the parallel duct.

A cross-sectional view of the parallel duct 32*a* taken along line 21-21 of FIG. 18F is shown in FIG. 21. The extendable inner duct 86 is a linearly extendable duct which allows the vertical duct 16 (or 70) to translate along the parallel duct 32*a*. The portions of the extendable inner duct 86 on either side of the vertical duct 16 (or 70) are generally to some degree compressed as shown by a heavily compressed portion 86*a*, and a lightly compressed (or expanded) portion 86*b*. The extendable inner duct 86 may also be somewhat stretchable.

Often, two or more locomotive engines are coupled, and a system having bonnets, ducts, and ECUs for processing locomotive exhaust simultaneously from two or more locomotives is intended to come within the scope of the present invention.

While the invention herein disclosed has been described by means of specific embodiments and applications thereof, numerous modifications and variations could be made thereto by those skilled in the art without departing from the scope of the invention set forth in the claims.

We claim:

1. A system for processing diesel locomotive exhaust, the system comprising:

an Emissions Control Unit (ECU) for processing locomotive exhaust;

at least one parallel duct running parallel to train tracks the duct including an extendable and compressible inner duct residing in the at least one parallel duct and the extendable and compressible inner duct is adapted to extend and compress within the at least one parallel duct to allow movement of the locomotive along the train tracks;

a slot forming a longitudinal opening into the at the least one parallel duct, the slot running substantially the length of the at the least one parallel duct;

seals running the length of the slot and ordinarily closing the slot to resist the escape of exhaust emitted from a locomotive exhaust pipe from the at least one parallel duct;

a duct transport unit adapted to slide along the at least one parallel duct and to open the seal as the duct transport unit slides along the at least one parallel duct, wherein the seal closes behind the duct transport unit;

a bonnet for capturing the exhaust emitted from the locomotive exhaust pipe;

a vertical duct connecting the bonnet to the duct transport unit carrying the captured exhaust from the bonnet to the duct transport unit; and a connecting duct connected to the at least one parallel duct for carrying the exhaust from the at least one parallel duct to the ECU.

2. The system of claim 1, wherein the bonnet is moveable to position over the locomotive exhaust pipe, the bonnet further including:

a shell having a closed perimeter enclosing a volume around a single locomotive exhaust pipe.

3. The system of claim 2, wherein the shell closes against a roof surface of the locomotive.

4. The system of claim 2, wherein the shell closes against an external surface of the locomotive exhaust pipe.

5. The system of claim 2, wherein the shell closes against an internal surface of the locomotive exhaust pipe.

6. The system of claim 3, wherein the bonnet is held in place against the locomotive roof by one of a group consisting of gravity, friction, mechanical means and electro-magnetic force.

7. The system of claim 3, wherein:

the vertical duct is an extendable vertical duct for carrying the exhaust from the shell to the horizontal duct; and the extendable vertical duct extends to allow the bonnet to be lowered against the locomotive and retracts to allow the bonnet to be raised away from the locomotive.

8. The system of claim 3, wherein the shell includes a fender along a lower edge, the fender sufficiently compliant so as to conform to the shape of the locomotive roof and to close against the roof.

9. A bonnet for capturing locomotive exhaust, the bonnet comprising:

a shell forming a volume for enclosing a single locomotive exhaust pipe and capturing exhaust from the locomotive exhaust pipe and held in place by an electromagnet; and a vertical duct connected to the shell and in fluid communication with the shell for receiving the exhaust captured by the shell, wherein the bonnet is moveable to position over the locomotive exhaust pipe, wherein the bonnet is not in direct contact with the single locomotive exhaust pipe and the bonnet relies on receiving locomotive exhaust from the enclosed volume around the single locomotive exhaust pipe.

10. The bonnet of claim 9, wherein the shell includes a fender around a lower edge of the shell for closing out outside air.

11. The bonnet of claim 10, wherein the fender is a compliant lower edge of the bonnet for closing against the roof of a locomotive.

12. The bonnet of claim 11, wherein the bonnet includes electromagnets for holding the compliant lower edge against a roof of the locomotive.

13. The bonnet of claim 11, wherein the compliant lower edge comprises a high-temperature silicon foam, encasing a structural member.

14. The bonnet of claim 11, wherein the compliant lower edge comprises a compliant material encasing a structural member comprising at least one of a group consisting of carbon-reinforced epoxy, ester, and of spring steel.

15. The bonnet of claim 10, wherein the fender closes against an external surface of the locomotive exhaust pipe.

16. The bonnet of claim 10, wherein the fender closes against an internal surface of the locomotive exhaust pipe.

17. The bonnet of claim 9, wherein a negative pressure is maintained within the bonnet.

18. The bonnet of claim 9, wherein:

the duct comprises an extendable vertical duct for carrying the exhaust from the shell to a manifold; and the extendable vertical duct extends to allow the bonnet to be lowered against a locomotive and retracts to allow the bonnet to be raised away from a locomotive.

19. The bonnet of claim 18, wherein the vertical duct is a telescoping duct thereby allowing the bonnet to be lowered against a locomotive and raised away from the locomotive.

20. The bonnet of claim 18, wherein the vertical duct is a flexible duct thereby allowing the bonnet to be lowered against a locomotive and raised away from the locomotive.

21. A system for processing diesel locomotive exhaust, the system comprising:

an Emissions Control Unit (ECU) for processing locomotive exhaust;

a bonnet for capturing locomotive exhaust emitted from a locomotive exhaust pipe of a locomotive; and an ECU rail car comprising:

a tower, a boom extending from the tower; and duct supports held by the boom, wherein:

the ECU is mounted on the ECU rail car;

a manifold comprises at least one connecting duct supported by the duct supports and providing fluid communication between the bonnet and the ECU; and the ECU rail car is carried on train tracks and the locomotive is carried by the same train tracks.

22. A bonnet for capturing locomotive exhaust, the bonnet comprising:

a shell forming a volume for enclosing a single locomotive exhaust pipe and capturing exhaust from the locomotive exhaust pipe; and a vertical duct connected to the shell and in fluid communication with the shell for receiving the exhaust captured by the shell, wherein the bonnet is moveable to position over the locomotive exhaust pipe;

wherein the shell comprises a tent and a frame, wherein the frame attaches to a hinge and the hinge and the frame are independently vertically supported, wherein vertically adjusting the hinge with respect to the frame causes the frame to narrow and widen.

23. The bonnet of claim 22, wherein the hinge and the frame are vertically supported by cables.

24. The bonnet of claim 22, wherein the hinge runs along a peak of the frame.

25. A bonnet for capturing locomotive exhaust, the bonnet comprising:

a shell forming a volume for enclosing a single locomotive exhaust pipe and capturing exhaust from the locomotive exhaust pipe; and a vertical duct connected to the shell and in fluid communication with the shell for receiving the exhaust captured by the shell, wherein the bonnet is moveable to position over the locomotive exhaust pipe, wherein;

no part of the bonnet is in direct contact with the single locomotive exhaust pipe and the bonnet relies on receiving locomotive exhaust from the enclosed volume around the single locomotive exhaust pipe; and the bonnet includes an air foil inside the shell for guiding exhaust into the vertical duct and stabilizing the exhaust flow into the vertical duct, wherein the air foil extends from the vertical duct towards the exhaust pipe and flairs to an increasing diameter.

26. A bonnet for capturing locomotive exhaust, the bonnet comprising:

a shell forming a volume for enclosing a single locomotive exhaust pipe and capturing exhaust from the locomotive exhaust pipe; and a vertical duct connected to the shell and in fluid communication with the shell for receiving the exhaust captured by the shell, wherein the bonnet is moveable to position over the locomotive exhaust pipe, wherein;

no part of the bonnet is in direct contact with the single locomotive exhaust pipe and the bonnet relies on receiving locomotive exhaust from the enclosed volume around the single locomotive exhaust pipe; and the ECU reduced particulate matter (PM), nitrogen oxides (NOx), sulfur dioxide ($SO_2$) and volatile organic compounds (VOCs) in the locomotive exhaust released to the environment.

* * * * *